United States Patent [19]

McCullough

[11] 4,199,308

[45] Apr. 22, 1980

[54] AXIAL COMPLIANCE/SEALING MEANS FOR IMPROVED RADIAL SEALING FOR SCROLL APPARATUS AND SCROLL APPARATUS INCORPORATING THE SAME

[75] Inventor: John E. McCullough, Carlisle, Mass.

[73] Assignee: Arthur D. Little, Inc., Cambridge, Mass.

[21] Appl. No.: 947,460

[22] Filed: Oct. 2, 1978

[51] Int. Cl.[2] ..... F01C 1/02; F01C 19/08; F04C 27/00

[52] U.S. Cl. ..... 418/55; 418/142; 418/144

[58] Field of Search ..... 418/55, 57, 142–144

[56] References Cited

U.S. PATENT DOCUMENTS

| | | | |
|---|---|---|---|
| 801,182 | 10/1905 | Creux | 418/55 |
| 3,384,055 | 5/1968 | Glenday et al. | 418/142 |
| 3,895,892 | 7/1975 | Sasaki | 418/142 |
| 3,994,636 | 11/1976 | McCullough et al. | 418/55 |
| 4,082,484 | 4/1978 | McCullough | 418/55 |

*Primary Examiner*—John J. Vrablik

*Attorney, Agent, or Firm*—Bessie A. Lepper

[57] ABSTRACT

Axial compliance/sealing means are provided for scroll-type apparatus. These means comprise seal elements associated with the involute wraps which are urged by an axial force to make sealing contact with the end plates of the opposing scroll members. A two-sided channel open to the centerline of the apparatus is cut in the contacting end of each wrap; and within the channel is positioned a seal element for making sealing contact with the surface of the end plate of the opposing or complementary scroll member. The seal element is compressively loaded toward the back of the channel and axially loaded toward the opposing end plate. The use of the axial compliance/sealing means allows the contacting surfaces through which radial sealing is effected to be machined to conventional accuracy, provides automatic compensation for temperature differentials within the apparatus as well as for any uneven wear of the scroll members, and permits the use of machining and fabrication techniques which are relatively low in cost.

27 Claims, 16 Drawing Figures

AXIAL COMPLIANCE/SEALING MEANS FOR IMPROVED RADIAL SEALING FOR SCROLL APPARATUS AND SCROLL APPARATUS INCORPORATING THE SAME

This invention relates to scroll-type apparatus and more particularly to scroll-type apparatus having axial and radial compliance/sealing means which materially reduce the problems of constructing the scroll-type apparatus and which enhance its extended operation.

There is known in the art a class of devices generally referred to as "scroll" pumps, compressors and expanders wherein two interfitting spiroidal or involute spiral elements of like pitch are mounted on separate end plates. These spiral elements are angularly and radially offset to contact one another along at least one pair of line contacts such as between spiral curved surfaces. A pair of line contacts will lie approximately upon one radius drawn outwardly from the central region of the scrolls. The fluid volume so formed therefore extends all the way around the central region of the scrolls. In certain special cases the pocket or fluid volume will not extend the full 360° but because of special porting arrangements will subtend a smaller angle about the central region of the scrolls. The pockets define fluid volumes, the angular position of which varies with relative orbiting of the spiral centers; and all pockets maintain the same relative angular position. As the contact lines shift along the scroll surfaces, the pockets thus formed experience a change in volume. The resulting zones of lowest and highest pressures are connected to fluid ports.

An early patent to Creux (U.S. Pat. No. 801,182) describes this general type of device. Among subsequent patents which have disclosed scroll compressors and pumps are U.S. Pat. Nos. 1,376,291, 2,475,247, 2,494,100, 2,809,779, 2,841,089, 3,560,119, 3,600,114, 3,802,809, and 3,817,664 and British Pat. No. 486,192.

Although the concept of a scroll-type apparatus has been known for some time and has been recognized as having some distinct advantages, the scroll-type apparatus of the above-identified prior art has not been commercially successful, primarily because of sealing and wearing problems which have placed severe limitations on the efficiencies, operating life, and pressure ratios attainable. Such sealing and wearing problems are of both radial and tangential types. Thus, effective axial contacting must be realized between the ends of the involute spiral elements and the end plate surfaces of the scroll members which they contact to seal against radial leakage and achieve effective radial sealing; and in some types of scroll apparatus effective radial contacting with minimum wear must be attained along the moving line contacts made between the involute spiral elements to seal against tangential leakage.

Early approaches to the attainment of acceptable radial sealing in prior art apparatus included machining the components (wraps and end plates) to accurate shapes for fitting with very small tolerances and using one or more mechanical axial constraints, e.g., bolts to force the surfaces into contact. The more recent prior art teaches sealing through the use of a compliant fixed scroll member (U.S. Pat. No. 3,874,827) or the use of a pressurized fluid (with or without springs to provide an augmenting axial force) to urge the scroll members into axial contact (U.S. Pat. Nos. 3,600,114, 3,817,664, 3,884,599, and 3,924,977). The recent prior art also includes improved radial sealing means, particularly suited for scroll-type compressors or expanders operating at high pressures, in which all of the forces required to achieve efficient axial load carrying are pneumatic forces provided by pressurizing all or a selected portion of the apparatus housing. Thus, the housing defines with a surface of the orbiting scroll member a pressurizable chamber whereby the fluid pressure within that chamber forces the orbiting scroll into continued axial contact relationship with the fixed scroll member.

The substitution of a compliant fixed scroll member with axial forces applied thereto or of pneumatic forces acting upon the orbiting scroll for the use of bolts to force surface contacts have gone a long way to the solving of the radial sealing problems in scroll-type apparatus. However, these techniques still require very accurate machining of both the contacting surfaces, i.e., the surfaces of the end plates and the surfaces of the involute spiral wrap members. This requirement of accurate machining adds materially to the cost of the scroll type apparatus manufacture. Moreover, any axial misalignment in the apparatus during operating will generally result in uneven wear, thus defeating the attainment of the accurate machining. Finally, radial temperature gradients within the apparatus give rise to uneven dimensional changes in the height of the involute wraps.

In U.S. Pat. No. 3,994,636 there is disclosed sealing means which permits the contacting surfaces to be machined only to conventional accuracy to attain acceptable axial contacting and hence efficient radial sealing. In this sealing means, a three-sided channel is cut in the tip surface of each of the wraps and it is formed to follow the configuration of the wrap. Within each channel is placed a compliance/sealing means through which the axial contact is effected. Each of the compliance/sealing means comprises in combination a seal element seated in the channel and of the same involute configuration as the channel and force applying means for actuating the seal element to effect the required axial contact. The width of the seal element is less than the width of the channel to permit the seal element to experience small radial and axial excursions within the channel; and the seal element has a contacting surface width which is less than the width of the wrap.

The use of the axial compliance/sealing means of U.S. Pat. No. 3,994,636 has proved effective in attaining satisfactory radial sealing. However, by making certain improvements in the axial compliance/sealing means structure disclosed and claimed in U.S. Pat. No. 3,994,636 it is possible to reduce the manufacturing cost associated with the radial seal while at the same time attaining a better machine finish on the channel surface. It is also possible to preload the seal element radially as well as loading it axially.

It is therefore a primary object of this invention to provide an improved axial compliance/sealing means for achieving radial sealing of scroll-type apparatus. It is another object to provide sealing means of the character described which makes it possible to form the actuating member of the sealing means by simple fabricating techniques and which reduces the manufacturing costs of the scroll members. Yet another object is to provide axial sealing means which are so constructed as to be radially loaded even during relative motion of the scroll members.

It is another primary object of this invention to provide improved scroll-type apparatus in which the contacting surfaces through which radial sealing is realized need be machined only to conventional accuracy. It is a further object of this invention to provide scroll-type apparatus of the character described which incorporate axial compliance/sealing means to effect efficient radial sealing during prolonged operation even though some radial temperature gradients are experienced within the apparatus and uneven wear of the contacting surfaces, through which radial sealing is attained, is brought about. A further object of this invention is to provide axial compliance/sealing means of the character described which may be used with a lubricant or which may be adapted for apparatus which must operate without lubricants.

It is an additional primary object of this invention to provide scroll-type apparatus including compressors, expansion engines and pumps which may be constructed at costs somewhat less than heretofore possible.

Other objects of the invention will in part be obvious and will in part be apparent hereinafter.

The invention accordingly comprises the features of construction, combinations of elements, and arrangement of parts which will be exemplified in the constructions hereinafter set forth, and the scope of the invention will be indicated in the claims.

According to one aspect of this invention there is provided a scroll member suitable for constructing a scroll apparatus, comprising in combination an end plate; an involute wrap attached to the end plate and having a two-sided channel cut along essentially the length of the surface of the wrap, the channel opening toward the centerline of the scroll element and having a back surface and a seating surface; a seal element positioned in the channel, compressively loaded toward the back surface of the channel and extending throughout essentially the entire length thereof, the seal element being suitable for making sealing contact with the surface of an end plate of a complementary scroll member forming part of the scroll apparatus; and seal spring means formed as a continuous strip engageable with the back surface of the channel and having a plurality of spring members configured to exert an axial force on the seal element in the direction of the end plate of the complementary scroll member.

According to another aspect of this invention there is provided a positive fluid displacement apparatus, comprising in combination a stationary scroll member having a stationary end plate and a stationary involute wrap having a two-sided channel cut along essentially the length of its contacting end surface, the channel opening toward the centerline of the apparatus and having a back surface and a seating surface; an orbiting scroll member having an orbiting end plate and an orbiting involute wrap having a two-sided channel cut along essentially the length of its contacting end surface, the channel opening toward the centerline of said apparatus and having a back surface and a seating surface, the stationary and the orbiting scroll members being complementary to each other; driving means for orbiting the orbiting scroll member relative to the stationary scroll member while maintaining the scroll members in a predetermined fixed angular relationship, whereby the stationary and the orbiting involute wraps define moving fluid pockets of variable volume and zones of different fluid pressure; means for providing an axial force to urge the stationary involute wrap into axial contact with the orbiting end plate and the orbiting involute wrap into axial contact with the stationary end plate thereby to achieve radial sealing of the pockets; and compliance/sealing means associated with each of the involute wraps, each compliance/sealing means comprising, in combination, a seal element positioned in the channel, compressively loaded toward the back surface of the channel and extending throughout essentially the entire length thereof, the seal element being suitable for making sealing contact with the surface of the end plate of the complementary scroll member forming part of the apparatus; and seal spring means formed as a continuous strip engageable with the back surface of the channel and having a plurality of spring members configured to exert an axial force on the seal element in the direction of the end plate of the complementary scroll member.

For a fuller understanding of the nature and objects of the invention, reference should be had to the following detailed description taken in connection with the accompanying drawings in which.

Figure 1:
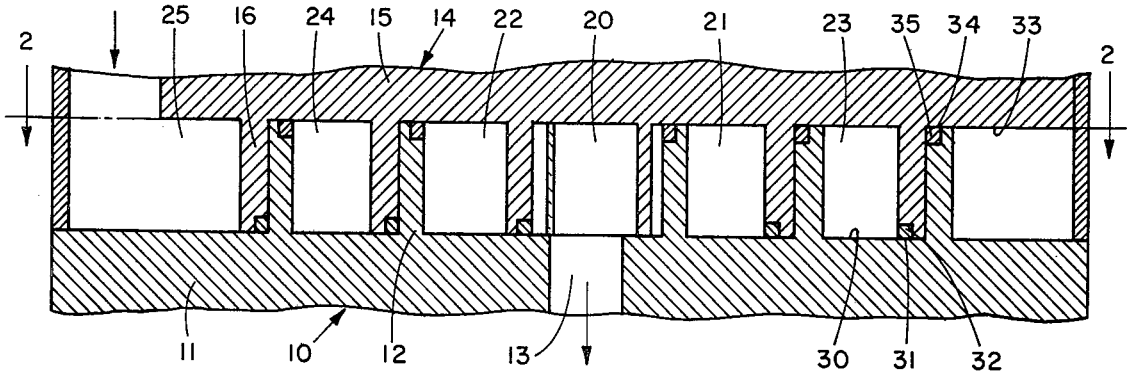
FIG. 1 is a partial cross section of the stationary and orbiting scroll members of a typical scroll apparatus taken through the machine axis and showing the location of the axial compliance/sealing means of this invention.

Inasmuch as radial sealing within scroll-type apparatus is an essential feature of such apparatus and since any axial contacting means must be capable of attaining radial sealing, it will be helpful, before describing the axial compliance/sealing means of this invention to briefly review the problems of radial sealing to understand the role which the axial compliance/sealing means of this invention must play in effectively sealing off the pockets within the apparatus to obtain efficient operation over extended periods of time with little or no maintenance. Since the principles of the operation of scroll apparatus have been presented in a number of previously issued patents, it is unnecessary to repeat a detailed description of the operation of such apparatus in discussing the problems faced in attaining effective radial sealing. It is only necessary to point out that a scroll-type apparatus operates by moving sealed pockets of fluid taken from one region into another region which may be at a different pressure. The sealed pockets of fluid are bounded by two parallel planes defined by end plates, and by two cylindrical surfaces, i.e., wraps, defined by the involute of a circle or other suitably curved configuration. The scroll members have parallel axes since in only this way can the continuous sealing contact between the plane surface of the scroll members be maintained. Movement of the pockets defined between the parallel surfaces of the end plates is effected as one cylindrical surface (flank of the wrap of the orbiting scroll member) is orbited relative to the other cylindrical surface (flank of the wrap of the stationary scroll member). In the case of compressors and expanders, the pressures in the moving pockets decrease radially outward, a fact which means that there is a pressure differential from one pocket to its radially adjacent pocket which makes it necessary to provide a sealing contact between the wrap end contacting surface and the end plate surface of the complementary or opposing scroll member to prevent fluid leakage from the higher- to the lower-pressure pockets. Thus, it will be seen that it requires some form of axial loading to ensure contact between the wrap end surfaces and end plates to achieve radial sealing.

In the design and construction of scroll-type apparatus tangential sealing may also be important. Tangential sealing may be achieved through maintaining line contact between the wrap flanks as the orbiting scroll member is moved. Since tangential and radial sealing are usually, but not always, attained through separate mechanisms, the axial compliance/sealing means of this invention may be employed in scroll-type apparatus using different tangential sealing techniques. The axial compliance/sealing means may also, however, be used in those scroll-type apparatus wherein a small clearance is maintained between the flanks of the wraps to minimize wear and in liquid pumps wherein tangential sealing is of lesser importance than in a compressor, for example. Thus, the axial compliance/sealing means of this invention are equally applicable to the scroll apparatus of U.S. Pat. Nos. 3,884,599, 3,924,977, 3,994,633, 3,994,635, 4,065,279, and 4,082,484 and to the scroll apparatus incorporating a peripheral drive as described in copending application Ser. No. 896,161 as well as to the scroll liquid pumps described in U.S. applications Ser. Nos. 807,413 and 807,414.

Figure 2:
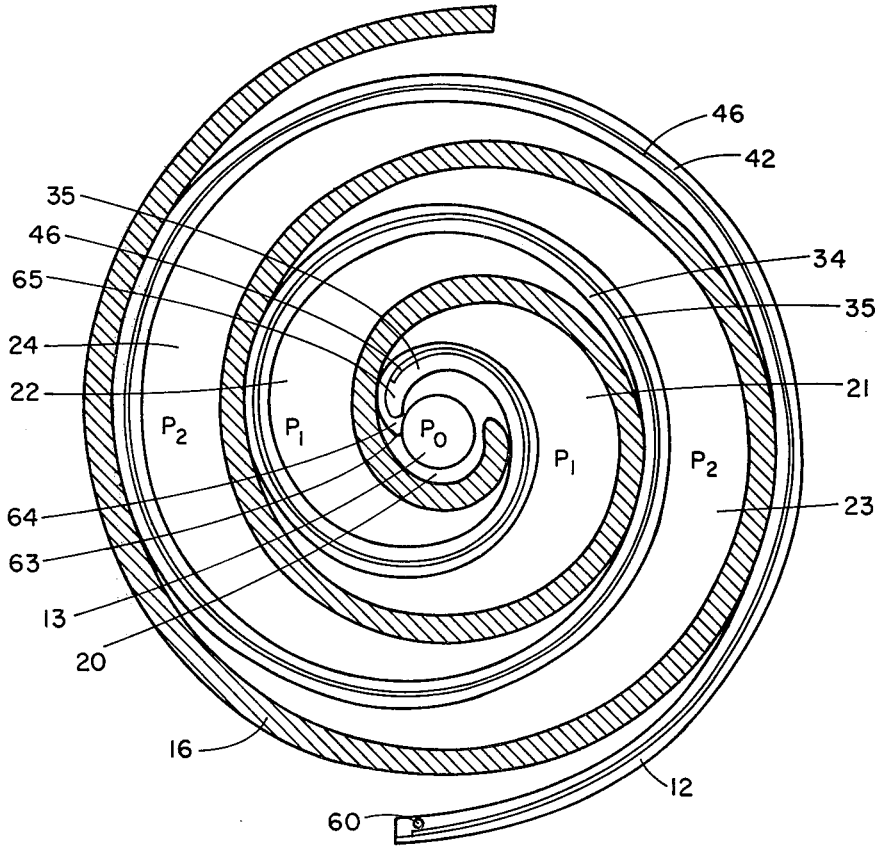
FIG. 2 is a cross section of the scroll apparatus of FIG. 1 taken through plane 2—2 of FIG. 1.
Figure 16:
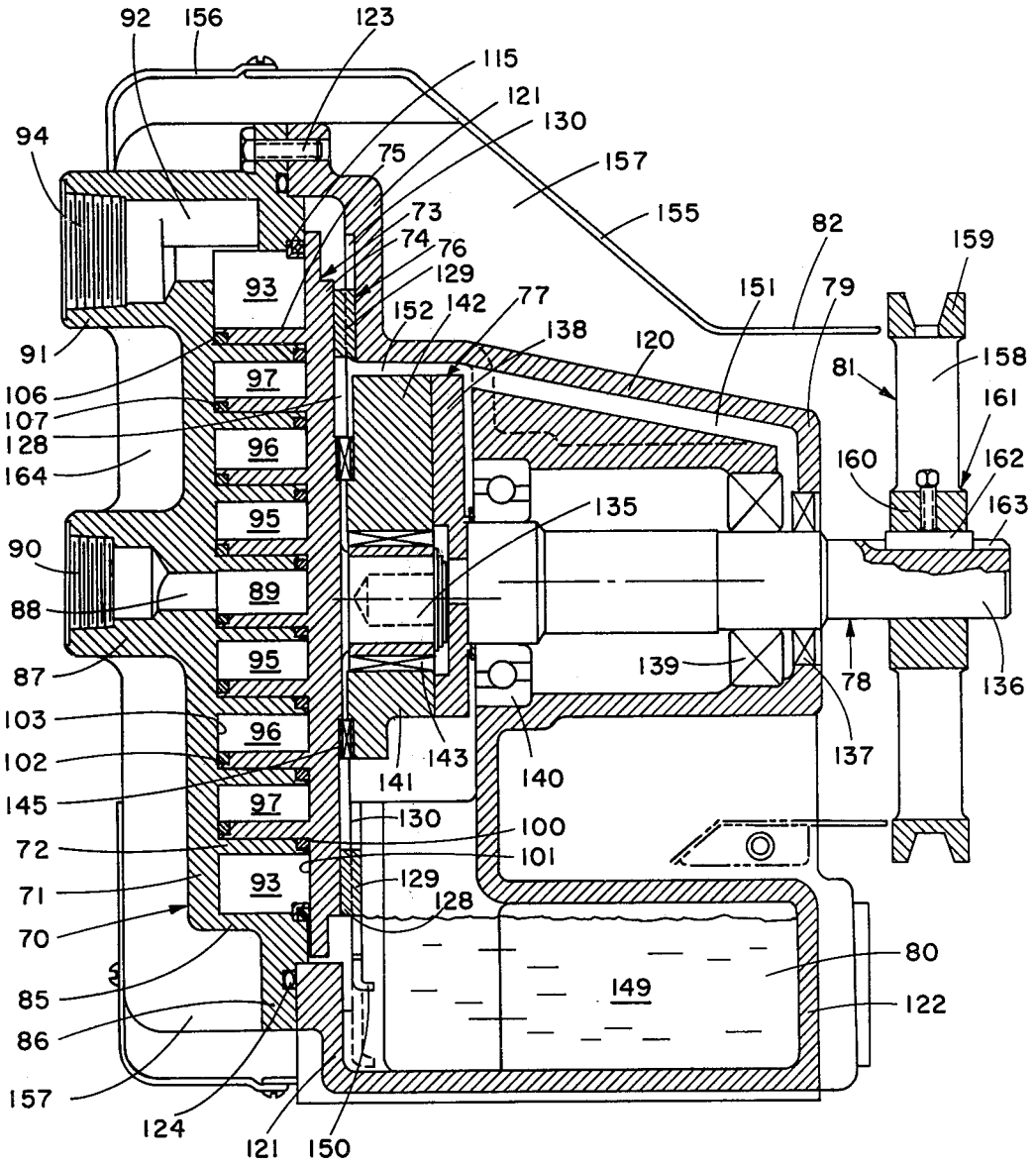
FIG. 16 is a longitudinal cross section of a scroll compressor incorporating the axial compliance/sealing means of this invention.

FIGS. 1 and 2 are presented to further illustrate the problem of providing radial sealing with compliance without the need for the extremely accurate machining of contacting surfaces. The cross sectional views of FIGS. 1 and 2 show only portions of end plates, wrap members and fluid pockets. A complete exemplary scroll-type apparatus embodying the sealing/compliance means of this invention is shown in FIG. 16 and is described in detail below.

In FIGS. 1 and 2, the stationary scroll member 10 is seen to comprise an end plate 11 and a wrap 12. End plate 11 has a centrally located fluid port 13. For convenience in discussing the compliance/sealing means of this invention and the scroll-type apparatus in which these means are incorporated, the apparatus will hereinafter be assumed to be a compressor. However, it will be apparent to those skilled in the art that the compliance/sealing means are equally applicable to scroll-type apparatus used as expansion engines or as pumps.

In FIGS. 1 and 2 the orbiting scroll member 14 is likewise formed of an end plate 15 and an involute wrap 16. In practice, the orbiting scroll member may be attached to a drive shaft (not shown) or caused to orbit through the use of a suitable peripheral drive mechanism. In operation, the orbiting scroll member 15 is driven to describe an orbit while the two scroll members are maintained in a fixed angular relationship. In its orbiting motion, the orbiting scroll member defines one or more moving fluid pockets, i.e., pockets 20–24 in which $P_0<P_1<P_2$ (FIG. 2). These pockets may be bounded radially by sliding or moving line contacts between wraps 12 and 16; or for some applications a small clearance may be maintained between the flank wraps (see for example U.S. Pat. No. 4,082,484). The fluid is taken through inlet line 25 into the peripheral zone 26 surrounding the wraps and from zone 26 it is introduced into the pockets and compressed as the pockets become smaller in volume as they approach the central pocket 20. Thus, only through effective radial sealing can the desired fluid pressures in the various moving pockets be maintained.

In the apparatus of this invention, this radial sealing is achieved through the contact of the surface 30 of stationary end plate 11 by the surface 31 of a seal element 32 seated in orbiting wrap 16 and axially forced against surface 30 and through the contact of the surface 33 of orbiting end plate 15 by the surface 34 of a seal element 35 seated in stationary wrap 12 and axially forced against surface 33. It will be appreciated that in FIG. 1, which is presented only for the purpose of discussing the general concept of radial sealing, the details of the axial compliance/sealing means of this invention are not shown.

Figure 3:
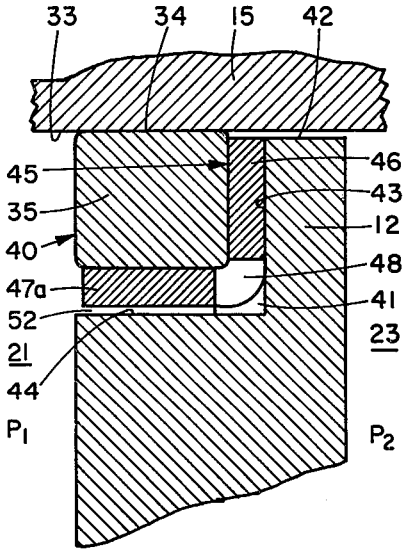
FIG. 3 is a much enlarged detailed cross section of the axial compliance/sealing means positioned in the wrap of a scroll member.
Figure 4:
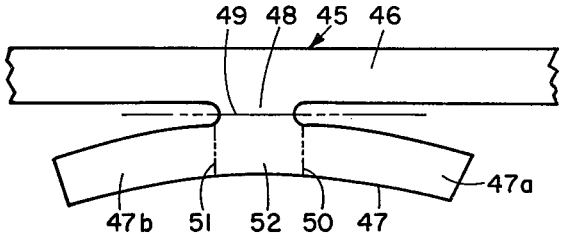
FIG. 4 is an enlarged planar view of a section of one embodiment of a seal spring blank prior to being folded to form the means to exert an axial force on the seal element.
Figure 5:
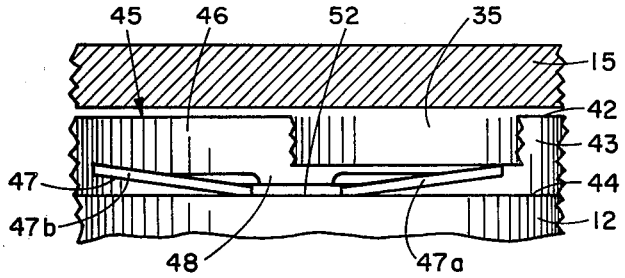
FIG. 5 is a front elevational view of the seal spring of FIG. 4 folded and in position in the wrap channel to support the seal element.
Figure 6:
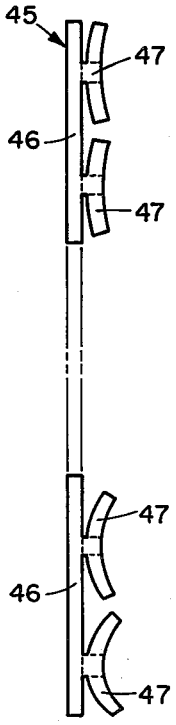
FIG. 6 is a planar view of the ends of a seal spring blank of the same design as that of FIGS. 4 and 5.
Figure 7:
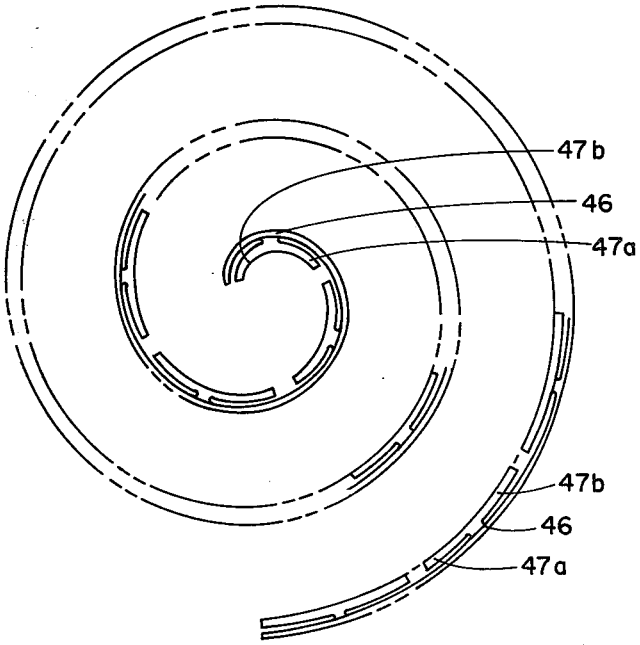
FIG. 7 illustrates the placement of the seal spring, formerly the blank shown in FIG. 6, in a scroll member wrap channel.
Figure 8:
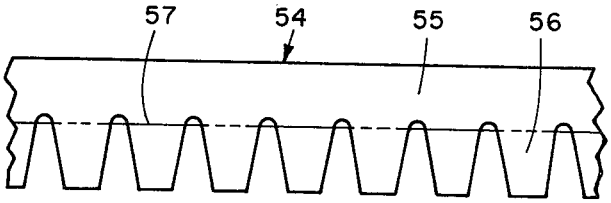
FIG. 8 is an enlarged planar view of a section of another embodiment of a seal spring blank prior to being folded.
Figure 9:
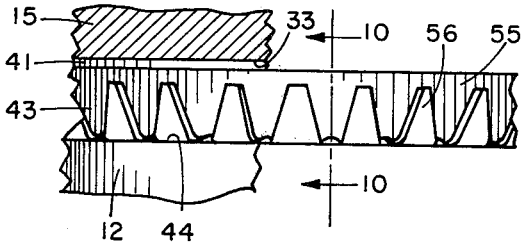
FIG. 9 is a front elevational view of the seal spring of FIG. 8 folded for placement in the wrap channel.
Figure 10:
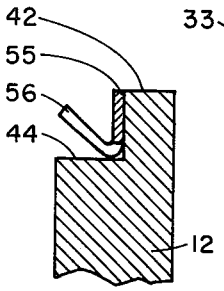
FIG. 10 is a cross section through a scroll member wrap showing the folded seal spring of FIG. 9, cut through plane 10—10, in position prior to placement of the seal element.

FIG. 3 is a cross section through the axial compliance/sealing means generally indicated by the numberal 40, associated with the wrap 12 of the stationary scroll member 10 and forming sealing contact with surface 33 of orbiting end plate 15. Since this sealing means is continuous along essentially the entire length of the wrap and since the construction of the sealing means associated with the involute wrap 16 of the orbiting scroll member 14 is identical to that shown in FIG. 3, this figure may be used to illustrate the axial compliance sealing means for both scroll members.

As noted previously, sealing contact is made between surface 34 of seal element 35 and end plate surface 33. Seal element 35 is set in a two-sided channel 41 cut in the end surface 42 of wrap 12. The channel thus has a back surface 43 which is normal to surface 33 of end plate 15 and a seating surface 44 which is preferably parallel to surface 33. Channel 41 opens inwardly toward the centerline of the scroll element. In order to ensure continuous sealing throughout the length of the involute wrap while at the same time minimizing frictional wear, a seal spring, generally indicated by the numeral 45, is provided to compliantly apply an axial force on seal element 35, the seal-element being so designed and seal spring member being so sized that the seal element always extends slightly above wrap surface 42.

The cutting of channel 41 with one open side achieves several advantages over the cutting of a three-sided groove such as shown in U.S. Pat. No. 3,994,636. For example, this present configuration permits the use of a large diameter cutter for machining out the channel which results in lower manufacturing costs; and a better machine finish on channel surfaces 43 and 44 is attained.

The seal spring 45 is preferably formed as a single continuous element. A first embodiment of such an element is illustrated in FIGS. 3–7 and a second embodiment in FIGS. 8–11. The seal spring of FIGS. 3–7 is formed by stamping and bending. As will be seen in FIGS. 4 and 6, the stamped out blank comprises a straight back member 46 and a plurality of arcuate spring members 47 centrally joined thereto through necks 48. In shaping the seal spring, the arcuate spring members 47 are bent on fold line 49 toward back member 46 to form a 90° angle; and the arms 47*a* and 47*b* of arcuate members 47 are bent upward along fold lines 50 and 51 to leave a central flat spring seat 52 which rests on seating surface 44 of channel 41. The required axial force is applied by spring arms 47*a* and 47*b* on which seal element 35 sits. As will be seen from FIGS. 6 and 7, the degree of curvature of the arcuate members preferably increases and their length preferably decreases along the length of the seal spring, the curvature being greatest and length being shortest at the inboard or central end of the involute channel. The actual degrees of curvature and lengths chosen for the spring members 47 will depend upon a number of factors and can be readily determined when such factors are established. These factors include the configuration of the involute wrap, the desired upward force to be exerted on seal element 35, the properties of the material from which seal element 35 is formed, and the amount of wear that can be tolerated.

The axial force of the seal spring must be at least that which prevents any appreciable leakage across the involute wrap end from a pocket of higher pressure, e.g., pocket 21 at $P_1$ to a pocket of lower pressure, e.g., pocket 23 at $P_2$. However, since the seal element 35 experiences some motion due to the orbiting of the orbiting scroll member and thus induces some motion in the spring seal, the axial force of the seal spring should not be of such a magnitude as to give rise to excessive wear of the seal element or of the spring seat 52 or to result in the development of excessive friction power dissipation. The use of a seal spring which operates to develop axial forces, along its entire length, of a magnitude which falls within the range specified provides an axial compliance/sealing means which has an extended fatigue life and which is able to operate many hours under the conditions of dynamic motion which are encountered in scroll apparatus.

The seal springs are formed from materials normally used in making flat springs, i.e., materials having a high fatigue limit, high endurance strength and high yield strength. Such materials include, but are not limited to, phosphor bronze, beryllium copper, spring steel and the like. Sheet thicknesses ranging between about 0.004 and 0.020 inch (about 0.01 and 0.05 cms) are generally preferred for forming the seal spring blanks.

Figure 11:
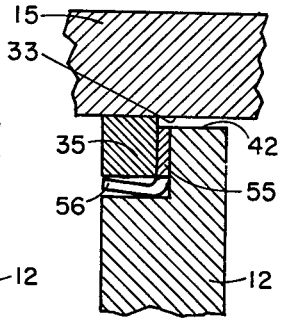
FIG. 11 is a cross section through a scroll member wrap showing the seal element in place on the seal spring of FIG. 10.

FIGS. 8–11 illustrate another embodiment of a seal spring suitable for the sealing means of this invention. As will be seen from FIG. 8, the stamped-out blank 54 is formed as a continuous back member 55 having a plurality of frustoconically configured tabs 56 serving as spring members. As will be seen in FIGS. 9 and 10, tabs 56 are folded toward back member 55 along fold line 57, tabs 56 being turned toward each other in the curving of channel 41 as seal spring is placed along the length of involute wrap 12. As in the case of arcuate members 47 of the seal spring of FIGS. 3–7, the shapes of tabs 56 are adjusted along the length of the seal spring to take into account the changing degree of curvature of the involute wrap from its inboard end to its outboard end. Likewise the degree of bending of tabs, i.e., the angle defined between tabs 56 and back member 55 (FIG. 10), is adjusted to attain a predetermined axial force on seal element 35. The range of the magnitude of such axial force is the same as that defined for the first seal spring embodiment. The manner in which such axial force is exerted on seal element 35 is shown in FIG. 11 wherein the reference numerals are the same as those in FIGS. 8–10.

Figure 12:
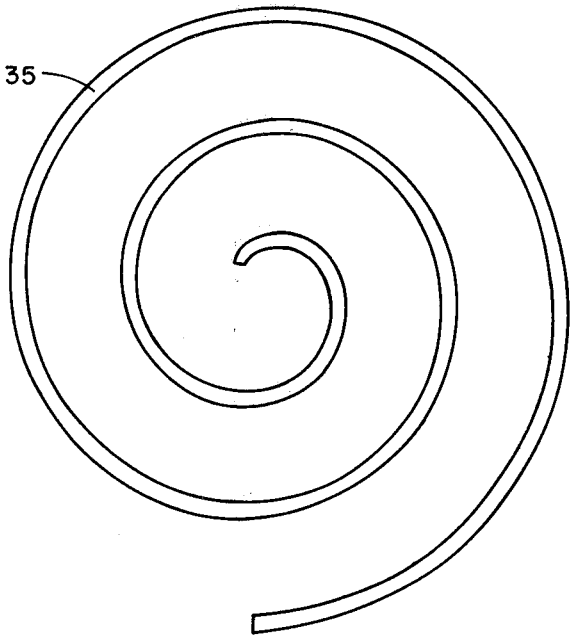
FIG. 12 is a top elevational view of the seal element of this invention.

The seal element 35, shown in a planar view in FIG. 12, is in essence a spring which is positioned and maintained in channel 41 to be compressively loaded toward back surface 43 of the channel. Thus, the seal element is radially loaded as well as axially loaded. As will be seen from the cross section of the seal element in FIG. 13, it is preferably of a rectangular configuration, the flat contacting surface 34 being somewhat narrower than seating surface 44 of channel 41 so that when the sealing means is assembled as in FIG. 3 or 11, the exposed surface of seal element 35 does not extend beyond the inner flank surface of the wrap.

Figure 14:
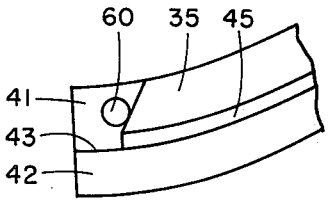
FIGS. 14 and 15 illustrate two embodiments of means to exert a small continuous tangential force on the seal element to maintain it in a compressively loaded condition.
Figure 15:
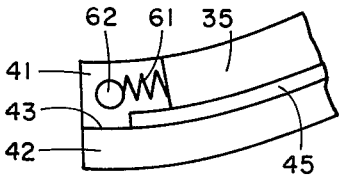

In assembling the axial compliance/sealing means in the channel of the scroll members the seal element is torqued in by pushing on the outboard end and held in this preloaded condition either by a stop pin 60 which is mounted at the outboard end of channel 41 (FIG. 14), or by a compressed spring 61 anchored to a pin 62 in the outboard end of channel 41. As will be seen in FIG. 2, the seal spring, i.e., back member 46, and seal-element 35 extend to within a short distance of the inboard end 63 of the involute wrap; while channel 41 is cut to the end 63 leaving only a terminal channel wall 64. There is thus defined a small free channel volume 65 which provides relief for the thermal expansion of the seal spring and seal element.

The circumferential preload on the seal element in the channel must be sufficient to provide continuous radial preloading between seal element 35 and back wall 43; but it must be less than that which prohibits free axial motion of the seal element up and down in the channel as brought about by the axial force exerted by the seal spring and the dynamic motion of the end plate of the opposing scroll member. As an example, it has been found that a preload force of about three pounds falls within this desired range.

In the axial compliance/sealing means of this invention the seal element in the open-sided channel is able to maintain the desired preloading and sealing at both the primary surface (end plate) and secondary surface (channel back) as a result of the axial and radial spring forces. Moreover, the inherent stiffness of the seal element, when supported at its periphery, prevents it from moving radially inward out of the channel under the friction loading encountered in the scroll apparatus.

Figure 13:
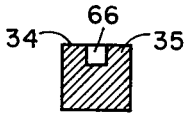
FIG. 13 is a cross section through one embodiment of the seal element showing a lubricant channel in the contacting surface.

Seal element 35 may be formed of a non-metallic material such as a polyimide or of a metallic material such as cast iron, hardened steel, chrome-plated steel and the like. The material must possess a degree of springiness to allow it to be preloaded in the wrap channel; and it must also, of course, exhibit a high predetermined resistance to wear inasmuch as it is the surface of the seal element which must continue to make moving sealing contact with the end plate of the opposing scroll member. It is within the scope of this invention to run the seal dry or with lubrication, and in the latter case seal element 35 may have a lubrication groove 66 cut in contacting surface 34 as shown in FIG. 13.

As previously pointed out, the axial compliance/sealing means of this invention may be used with many different types of scroll apparatus including, but not limited to, the apparatus described in U.S. Pat. Nos. 3,874,827, 3,884,599, 3,924,977, 3,986,799, 3,994,633, 3,994,635, 4,065,279, and 4,082,484. The sealing means may also be used in scroll apparatus designed exclusively as pumps such as those disclosed and claimed in copending applications Ser. Nos. 807,413 and 807,414 filed June 17, 1977, as well as in scroll apparatus employing peripheral drive means such as disclosed and claimed in U.S. Ser. No. 896,161 filed Apr. 14, 1978. The three mentioned applications are assigned to the same assignee as the present application.

In illustrating the application of the axial compliance/sealing means of this invention, the scroll apparatus of U.S. Pat. No. 4,082,484 may be taken as exemplary. A longitudinal cross section of such an apparatus is shown in FIG. 16 which is described hereinafter, for convenience, as a compressor.

The compressor shown in FIG. 16 is comprised of a stationary scroll member 70 formed of an end plate 71 and involute wraps 72; an orbiting scroll member 73 formed of an end plate 74 and involute wraps 75; a coupling member 76, a drive mechanism generally indicated by reference numeral 77; crank and shaft assembly means generally indicated by reference numeral 78; housing 79 including an oil sump 80, cooling fan 81 and cover 82.

End plate 71 of the stationary scroll member terminates in a peripheral ring 85 and an outwardly extending flange 86, these portions of end plate 71 forming a part of the apparatus housing. End plate 71 also has a central stub extension 87 defining a high-pressure fluid passage 88 in communication with high-pressure fluid pocket 89 defined by wraps 72 and 75. This central stub extension 87 is internally threaded at 90 for engagement with a high-pressure fluid conduit (not shown). End plate 71 also has a peripherally positioned stub extension 91 defining a low-pressure fluid passage 92 communicating with the low-pressure peripheral fluid pocket 93 and being threaded at 94 for engagement with a low-pressure fluid conduit (not shown).

Radial sealing of the fluid pockets 89, 93 and intermediate-pressure pockets 95, 96, and 97, is achieved across end surfaces 100 of stationary scroll member wraps 72 and the inner surface 101 of orbiting scroll end plate 74 and across end surfaces 102 of orbiting scroll member wraps 75 and the inner surface 103 of stationary scroll end plate 71. This is accomplished through the use of the axial compliance/sealing means of this invention, only channel 106 (equivalent to channel 41 of FIG. 3) and a seal element 107 (equivalent to seal element 35 of FIG. 3) being shown.

The diameter of end plate 74 of the orbiting scroll member is sufficiently great such that it always extends beyond the inner edge of flange 86, thus permitting the placement of an oil seal ring 115 between end plate 74 and flange 86 to seal off the fluid pockets from the remainder of the apparatus. This in turn allows the drive mechanism and bearings to be oil-lubricated while maintaining the working fluid substantially free from any liquid, since it is the purpose of the oil seal ring to prevent the passage of any lubricating oil in the volume surrounding the orbiting scroll member from entering the moving fluid pockets.

The housing, generally indicated by the reference numeral 79, is comprised of ring extension 85 of the stationary scroll member, flange 86, and main housing section 120 which is flanged at 121 and is integral with a lower oil sump housing 122. The housing is attached and sealed to the scroll members through flanges 86 and 121 by a plurality of bolts 123 using an o-ring seal 124.

In operation, the two scroll members must be maintained in a fixed angular relationship, and this is done through the use of coupling member 76. The coupling member illustrated in the apparatus embodiment of FIG. 16 is essentially the same as the coupling member described in U.S. Pat. No. 3,994,633 (see FIG. 14 of that patent and the detailed description thereof). Thus, as seen in FIG. 16, the coupling member comprises a ring 128 having oppositely disposed keys 129 on one side thereof slidingly engaging keyways 130 in the inner surface of housing flange 121. A second pair of keys (not shown) are oppositely disposed on the other side of coupling ring 128 to slidingly engage keyways in the end-plate of the orbiting scroll member. It is also, of course, within the scope of this invention to use any other suitable coupling means such as that described and claimed in copending application Ser. No. 722,713, filed Sept. 13, 1976, in the name of John E. McCullough and assigned to the same assignee.

Orbiting scroll member 73 has a stub shaft 135 affixed to or integral with end plate 74. The orbiting scroll is driven by a motor (not shown) external of the housing and engageable with compressor shaft 136 extending into the housing through an oil seal 137 and terminating in a crank plate 138 which may be affixed to or integral with shaft 136. Shaft 136 is mounted in the housing through shaft bearing 139 and crank bearing 140.

The driving means of the scroll apparatus of FIG. 16 is designed to use a fixed throw crank drive mechanism and to operate with a small clearance between the flanks of the wraps of the scroll members. Since this drive mechanism is not a part of the present invention it is not necessary to describe it in detail. Rather, reference may be had to the detailed description of the driving means in U.S. Pat. No. 4,082,484 incorporated herein by reference. The remaining description of FIG. 16 will therefore not present in great detail the driving means of the compressor shown.

As will be seen in FIG. 16, the orbiting scroll member is affixed to drive shaft 136 through bearing mount 141 having a counterweight 142 for the purpose of balancing the centrifugal force of the orbiting scroll member. Bearing mount 141 engages the stub shaft 135 through needle bearing 143 held in place by a snap ring. Interposed between bearing mount 141 and the outer surface of the end plate of orbiting scroll member 73 is a thrust face bearing 145 which acts as the axial force-applying means to urge the end plates and wrap ends of the two scroll members together to realize the desired axial sealing through the axial compliance/sealing means. Thrust face bearing 145 carries the load from orbiting scroll member 73 through the crank bearing 140 and subsequently to the housing. Main shaft 136, crank plate 138, bearing mount 141 and counterweight 142 make up the adjustable fixed-throw drive meachanism of the scroll machinery.

As noted above with regard to the general description of the apparatus illustrated in FIG. 16, there is provided an oil sump 80 in lower section 122 of the apparatus housing. The lubricating oil 149 from sump 80 is delivered to coupling member 76 and to the various shaft and drive bearings within housing 79 by means of one or more oil fingers 150 affixed to the coupling member. These oil fingers are of a length such that they are periodically dipped into oil 149 and then raised to fling the oil upward within the housing for circulation and return into the oil sump. An oil passage 151 is provided to conduct some of the oil flung directly into housing cavity 152, which surrounds the crank plate and bearing mount, to shaft bearing 139.

In the apparatus embodiment of FIG. 16 means are provided to air cool the compressor housing, and through the housing to air cool the elements of the compressor and the circulating lubricating oil. An air duct 155, terminating in a duct cover 156, is mounted around the apparatus housing and supported on the drive end of a plurality of housing fin member 157. Cooling air is circulated through the air duct 155 by means of fan 81 which comprises a plurality of fan blades 158 mounted between the outer, belt-engaging rim 159 and the inner shaft engaging ring 160 of a pulley 161. Pulley 161 is affixed to main shaft 136 through a key 162 engageable with keyway 163 in shaft 136. Duct cover 156 is affixed to the scroll member end of the housing fin members 157, and it terminates short of covering the scroll member end in order to leave a series of air discharge openings 164 so that air drawn in by fan 81 is circulated over the apparatus housing from drive end to scroll member end and discharged through openings 164.

Through the use of the axial compliance/sealing means of this invention in scroll apparatus to make sealing contact between the involute wraps and their opposing end plates it is possible to achieve efficient radial sealing through the entire length of each wrap even though there may exist temperature gradients and some uneven wearing of the end plate surfaces. Thus, effective sealing and efficient operation is possible for scroll-apparatus incorporating the axial compliance/-sealing means of this invention. This advantageous operation is obtained at a low cost since the machining of the seal channels, the formation of the seal springs and the manufacture and installation of the seal elements are all accomplished using readily available machining equipment and relatively simple fabrication techniques.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

I claim:

1. A scroll member suitable for constructing a scroll apparatus, comprising in combination (a) an end plate;

(b) an involute wrap attached to said end plate and having a two-sided channel cut along essentially the length of the surface of said wrap, said channel opening toward the centerline of said scroll element and having a back surface and a seating surface;

(c) a seal element positioned in said channel, compressively loaded toward said back surface of said channel and extending throughout essentially the entire length thereof, said seal element being suitable for making sealing contact with the surface of an end plate of a complementary scroll member forming part of said scroll apparatus; and (d) seal spring means formed as a continuous strip engageable with said back surface of said channel and having a plurality of spring members configured to exert an axial force on said seal element in the direction of said end plate of said complementary scroll member.

2. A scroll member in accordance with claim 1 wherein said channel is right-angled, said back surface being essentially normal to said surface of said end plate of said complementary scroll member and said sealing surface being essentially parallel therewith.

3. A scroll member in accordance with claim 1 wherein said seal element is a spring having a flat contacting surface and a rectangular cross section.

4. A scroll member in accordance with claim 3 wherein said flat surface of said seal element has a lubrication groove cut along essentially its entire length.

5. A scroll member in accordance with claim 3 wherein said seal element is of a dimension such that during operation of said scroll apparatus said flat contacting surface extends slightly beyond said surface of said wrap whereby there remains a small clearance between said surface of said wrap and said surface of said end plate of said complementary scroll member.

6. A scroll member in accordance with claim 1 wherein said seal spring means is cut as a single element with said spring members integral with said continuous strip and configured to exert said axial force by bending.

7. A scroll member in accordance with claim 6 wherein said spring members are arcuate in configuration and integral with said continuous strip through centrally located short necks.

8. A scroll member in accordance with claim 6 wherein said spring members are frustoconical in configuration.

9. A scroll member in accordance with claim 1 including means to maintain said seal element compressively loaded in said channel.

10. A scroll member in accordance with claim 9 wherein said means to maintain said seal element compressively loaded in said channel comprises a stop pin mounted at the outboard end of said channel.

11. A scroll member in accordance with claim 9 wherein said means to maintain said seal element compressively loaded in said channel comprises a spring in compression anchored at the outboard end of said channel.

12. An apparatus in accordance with claim 1 including means to maintain said seal element compressively loaded in said channel.

13. An apparatus in accordance with claim 12 wherein said means to maintain said seal element compressively loaded in said channel comprises a stop pin mounted at the outboard end of said channel.

14. An apparatus in accordance with claim 12 wherein said means to maintain said seal element compressively loaded in said channel comprises a spring in compression anchored at the outboard end of said channel.

15. A positive fluid displacement apparatus, comprising in combination (a) a stationary scroll member having a stationary end plate and a stationary involute wrap, said wrap having a two-sided channel cut along essentially the length of its contacting end surface, said channel opening toward the centerline of said apparatus and having a back surface and a seating surface;

(b) an orbiting scroll member having an orbiting end plate and an orbiting involute wrap, said wrap having a two-sided channel cut along essentially the length of its contacting end surface, said channel opening toward the centerline of said apparatus and having a back surface and a seating surface, said stationary and said orbiting scroll members being complementary to each other;

(c) driving means for orbiting said orbiting scroll member relative to said stationary scroll member while maintaining said scroll members in a predetermined fixed angular relationship, whereby said stationary and said orbiting involute wraps define moving fluid pockets of variable volume and zones of different fluid pressure;

(d) means for providing an axial force to urge said stationary involute wrap into axial contact with said orbiting end plate and said orbiting involute wrap into axial contact with said stationary end plate thereby to achieve radial sealing of said pockets; and (e) compliance/sealing means associated with each of said involute wraps, each compliance/sealing means comprising, in combination (1) a seal element positioned in said channel, compressively loaded toward said back surface of said channel and extending throughout essentially the entire length thereof, said seal element being suitable for making sealing contact with the surface of the end plate of the complementary scroll member forming part of said apparatus; and (2) seal spring means formed as a continuous strip engageable with said back surface of said channel and having a plurality of spring members configured to exert an axial force on said seal element in the direction of the end plate of said complementary scroll member.

16. An apparatus in accordance with claim 15 wherein said seal elements are springs having flat contacting surfaces, rectangular cross sections and dimensions such that during operation of said apparatus said flat contacting surfaces extend slightly beyond said contacting surfaces of said wraps whereby there remain small clearances between said contacting surfaces of said wraps and said surfaces of said end plates.

17. An apparatus in accordance with claim 15 wherein said seal spring means is cut as a single element with said spring members integral with said continuous strip and configured to exert said axial force by bending.

18. An apparatus in accordance with claim 17 wherein said spring members are arcuate in configuration and integral with said continuous strip through centrally located short necks.

19. An apparatus in accordance with claim 17 wherein said spring members are frustoconical in configuration.

20. An apparatus in accordance with claim 15 including means to maintain said seal elements compressively loaded in said channels.

21. An apparatus in accordance with claim 20 wherein said means to maintain said seal elements compressively loaded in said channels comprise stop pins mounted at the outboard ends of said channels.

22. An apparatus in accordance with claim 21 wherein said means to maintain said seal elements compressively loaded in said channels comprise springs in compression anchored at the outboard ends of said channels.

23. In a positive fluid displacement apparatus into which fluid is introduced through an inlet port for circulation therethrough and subsequently withdrawn through a discharge port, and comprising a stationary scroll member having an end plate and an involute wrap and an orbiting scroll member having an end plate and an involute wrap, driving means for orbiting said orbiting scroll member with respect to said stationary scroll member whereby said involute wraps seal off and define pockets of variable volume and zones of different fluid pressure, means to maintain said scroll members in fixed angular relationship, means for providing an axial force to urge said involute wrap of said stationary scroll member into axial contact with said end plate of said orbiting scroll member and said involute wrap of said orbiting scroll member into axial contact with said end plate of said stationary scroll member thereby to achieve radial sealing of said pockets, the improvement comprising axial compliance/sealing means associated with each of said involute wraps and each comprising, in combination (a) a right-angled, two-sided channel cut along essentially the length of the contacting surface of each of said wraps, said channels opening toward the centerline of said apparatus and having a back surface and a seating surface;

(b) a seal element positioned in said channel, compressively loaded toward said back surface of said channel and extending throughout essentially the entire length thereof, said seal element being suitable for making sealing contact with the surface of an end plate of a complementary scroll member forming part of said scroll apparatus; and (c) seal spring means formed as a continuous strip engageable with said back surface of said channel and having a plurality of spring members configured to exert an axial force on said seal element in the direction of said end plate of said complementary scroll member.

24. An apparatus in accordance with claim 23 wherein said seal element is a spring having a flat contacting surface, a rectangular cross section and dimensions such that during operation of said apparatus said flat contacting surface extends slightly beyond said contacting surface of said wrap whereby there remains a small clearance between said contacting surface of said wrap and said surface of the contacted end plate.

25. An apparatus in accordance with claim 23 wherein said seal spring means is cut as a single element with said spring members integral with said continuous strip and configured to exert said axial force by bending.

26. An apparatus in accordance with claim 25 wherein said spring members are arcuate in configuration and integral with said continuous strip through centrally located short necks.

27. An apparatus in accordance with claim 25 wherein said spring members are frustoconical in configuration.

* * * * *